US008139986B2

(12) United States Patent
Pensold et al.

(10) Patent No.: US 8,139,986 B2
(45) Date of Patent: Mar. 20, 2012

(54) ARRANGEMENT FOR CONVEYING TONER FROM A TONER SUPPLY CONTAINER INTO A TONER RECEIVING CONTAINER

(75) Inventors: Dietrich Pensold, Wasserburg (DE); Reinhold Schmidl, Fürstenfeldbruck (DE); Michael Lay, Mühldorf (DE); Martin Zehentbauer, Gauting (DE)

(73) Assignee: Oce Printing Systems GmbH, Poing (DE)

( * ) Notice: Subject to any disclaimer, the term of this patent is extended or adjusted under 35 U.S.C. 154(b) by 770 days.

(21) Appl. No.: 12/279,824

(22) PCT Filed: Feb. 15, 2007

(86) PCT No.: PCT/EP2007/051461

§ 371 (c)(1),
(2), (4) Date: Aug. 18, 2008

(87) PCT Pub. No.: WO2007/093625

PCT Pub. Date: Aug. 23, 2007

(65) Prior Publication Data

US 2009/0016770 A1 Jan. 15, 2009

(30) Foreign Application Priority Data

Feb. 16, 2006 (DE) ..... 10 2006 007 304

(51) Int. Cl.
*G03G 15/08* (2006.01)

(52) U.S. Cl. ..... 399/258; 399/113; 399/262

(58) Field of Classification Search ..... 399/113, 399/119, 258, 262

See application file for complete search history.

(56) References Cited

U.S. PATENT DOCUMENTS 5,091,750 A 2/1992 Yoshida et al.
5,475,469 A 12/1995 Okada et al.
(Continued)

FOREIGN PATENT DOCUMENTS

DE 44 37 070 4/1995
(Continued)

OTHER PUBLICATIONS

Patent Abstracts of Japan—040666983 A—Mar. 3, 1992—Toner Replenishing Device.

*Primary Examiner* — David Gray
*Assistant Examiner* — Barnabas Fekete
(74) *Attorney, Agent, or Firm* — Schiff Hardin LLP

(57) ABSTRACT

In an arrangement to convey toner from a toner bottle of a toner reservoir into a toner receiving container, the toner bottle has a cover to close an output opening thereof. The cover has an upper cover part to accept the toner bottle and a lower cover part to close the outlet opening. A first locking unit provided within the cover arresting the lower cover part to the upper cover part such that it cannot be displaced before placement of the toner reservoir onto the toner receiving container. The cover is receivable on the toner receiving container so that the outlet opening of the toner reservoir is positioned above a filling opening of the toner receiving container. A slider has an outlet opening, the slider closing or opening the filling opening of the toner receiving container. The slider has an unlocking unit that unlocks the first locking unit upon placement of the toner reservoir on the toner receiving container so that the lower cover part is no longer arrested to the upper cover part. The lower cover part and the slider have a latching unit that engages in an active connection upon placement of the toner reservoir onto the toner receiving container so that the lower cover part moves with movement of the slider.

30 Claims, 10 Drawing Sheets

U.S. PATENT DOCUMENTS

| | | | | |
|---|---|---|---|---|
| 5,475,479 | A | 12/1995 | Hatakeyama et al. | |
| 5,520,229 | A | 5/1996 | Yamada | |
| 5,734,953 | A | 3/1998 | Tatsumi | |
| 6,366,742 | B1 | 4/2002 | Reihl et al. | |
| 6,463,243 | B1 | 10/2002 | Boogert et al. | |
| 2002/0025197 | A1 | 2/2002 | Mizoguchi et al. | |
| 2002/0085857 | A1 | 7/2002 | Kim et al. | |
| 2007/0196136 | A1 * | 8/2007 | Yamamoto et al. | 399/258 |

FOREIGN PATENT DOCUMENTS

| | | |
|---|---|---|
| DE | 196 06 097 | 8/1996 |
| EP | 0 571 767 | 12/1993 |
| EP | 1 176 477 | 1/2002 |
| EP | 1 179 755 | 2/2002 |
| JP | 63-179377 | 7/1988 |
| WO | WO 00/19278 | 4/2000 |

* cited by examiner

DE

DE

ARRANGEMENT FOR CONVEYING TONER FROM A TONER SUPPLY CONTAINER INTO A TONER RECEIVING CONTAINER

BACKGROUND

The bottling of consumable material from a container in a receiving agent is of particular importance in electrographic printers or copiers. In this use case it is necessary to continually introduce toner as a consumable material in at least one developer station as a receiving agent. The function of such a printer or copier is known from WO 00/19278, for example. The addition of toner to the developer station is described there as well; WO 00/19278 is expressly referenced and its content is additionally incorporated into the disclosure. It is described how a container with toner can be connected with a developer station in order to fill new toner into the developer station. It is additionally described how the content of the container for the toner can be recorded, for example in a transponder, in order to ensure that only the correct toner is filled into the developer station.

An arrangement to convey toner into a toner receiving container is likewise known from U.S. Pat. No. 6,463,243 B1 or EP 1 176 477 A1. The toner receiving container has a filling opening that can be opened or closed by a slider. A container for new toner (toner reservoir) contains a funnel-shaped device that can be closed by a cover. The slider can be coupled with the cover so that both can be opened together in order to fill new toner into the toner receiving container.

Additional arrangements for conveying toner into a toner receiving container are known from DE 196 06 097 A1 and DE 44 37 070 A1. DE 196 06 097 A1 describes an arrangement in which a closing part under spring tension closes the filling opening for the toner in the toner receiving container. By sliding the closing part along a guide rail, the closing part rotates and uncovers the filling opening so that toner can be filled into the toner receiving container. An arrangement results from DE 44 37 070 A1 in which a cylindrical toner reservoir is placed on a closing part of the toner receiving container and a connection is thereby established between the toner reservoir and the toner receiving container. By rotating the toner reservoir, the closing part for the toner receiving container and the toner reservoir is simultaneously opened so that toner can flow into the toner receiving container. By rotating the toner reservoir back, the connection between this and the toner receiving container is broken and the two containers are simultaneously close.

U.S. Pat. No. 5,520,229 A describes a toner reservoir that can be placed on a toner receiving container. The toner reservoir is sealed with a strip that is round around a sliding means, which strip can be pulled away from the toner reservoir together with the sliding means by an operator with a handle.

An additional arrangement with a toner reservoir results from U.S. Pat. No. 5,091,750 A. The toner reservoir is closed with an adapter that provides a top cover part with a an upper slider and a lower slider. The upper slider closes the toner reservoir; the lower slider arrests the upper slider. Upon placing the toner reservoir on a receiving device that is arranged adjacent to the toner receiving container, the lower slider enters into an active connection with the receiving device and thereby releases the upper slider, which furthermore remains arrested. The toner reservoir is slid laterally by the operator to the opening of the toner receiving container. The upper slider thereby enters into an active connection with the cover of the toner receiving container and opens the toner receiving container. In addition, the upper slider is released, such that it can open the toner reservoir. The connection with the lower slider is reestablished by sliding the toner reservoir back.

JP 04-066 983 A describes an arrangement in which it is prevented that too much toner is filled into a toner receiving container.

WO 2000/19278 A1 deals with a printing system in which it is monitored whether toner of the correct color is filled into the developer stations given color printing. A transponder in which the data of the toner in the developer stations are stored can respectively be used for this.

US 2002/025 197 A1 discloses an arrangement to fill toner into a developer station. The opening of the developer station can be closed with the aid of an elastic means when no reservoir is placed on the developer station.

SUMMARY

It is an object to specify an arrangement with which new toner can be filled from a toner reservoir into a toner receiving container, for example into a toner box of a developer station of a printer or copier.

In an arrangement to convey toner from a toner bottle of a toner reservoir into a toner receiving container, the toner bottle has a cover to close an output opening thereof. The cover has an upper cover part to accept the toner bottle and a lower cover part to close the outlet opening. A first locking unit provided within the cover arresting the lower cover part to the upper cover part such that it cannot be displaced before placement of the toner reservoir onto the toner receiving container. The cover is receivable on the toner receiving container so that the outlet opening of the toner reservoir is positioned above a filling opening of the toner receiving container. A slider has an outlet opening, the slider closing or opening the filling opening of the toner receiving container. The slider has an unlocking unit that unlocks the first locking unit upon placement of the toner reservoir on the toner receiving container so that the lower cover part is no longer arrested to the upper cover part. The lower cover part and the slider have a latching unit that engages in an active connection upon placement of the toner reservoir onto the toner receiving container so that the lower cover part move with movement of the slider.

DESCRIPTION OF THE PREFERRED EMBODIMENT

Figure 1:
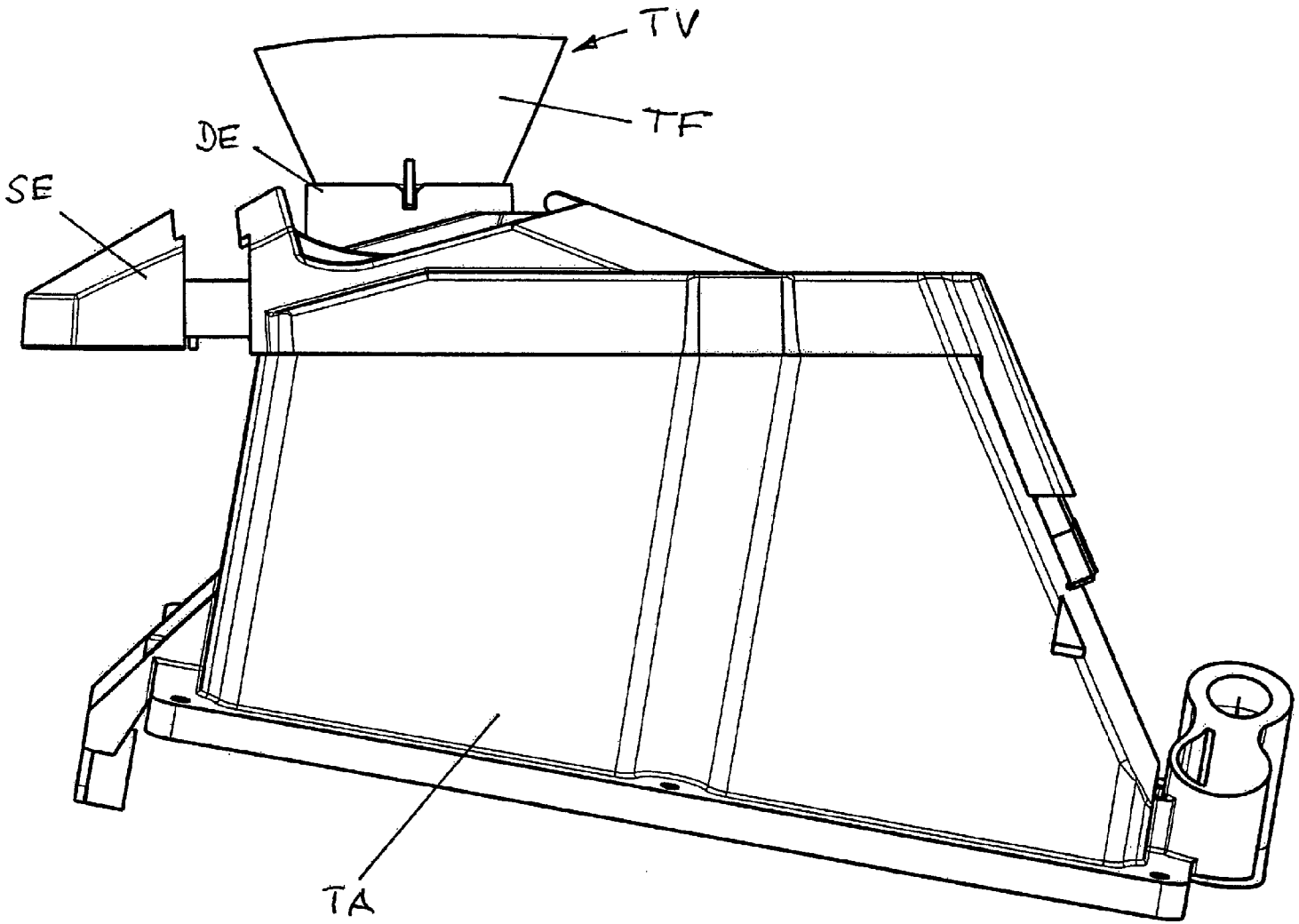
FIG. 1 shows the arrangement with the toner reservoir and the toner receiving container.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The preferred embodiment is realized such that the supply of the toner receiving container with toner is accomplished such that the safety of an apparatus (for example an electrographic printer or copier) in which the toner should be used is ensured, such that this is soiled as little as possible, and the operator is protected from contact with toner.

In order to convey the toner from the toner reservoir into the toner receiving container, according to the preferred embodiment an arrangement is proposed made up of: a toner reservoir for the toner with a first closing means unit for its outlet opening; and a toner receiving container for the toner with a second closing unit for its filling opening; in which the closing units are adapted to one another so that they can enter into an active connection, such that they can be placed on one another;

they can be arrested on one another;

they can be moved together;

they are sealed.

In order to achieve this goal, an arrangement is proposed in which a cover made from an upper cover part to accept a toner bottle and a lower cover part (which can be slid and arrested in a guide) to close the outlet opening of the toner bottle, which lower cover part can be inserted into a frame on the toner receiving container such that the outlet opening of the toner reservoir is positioned adjacent to the filling opening of the toner receiving container, in which a slider possessing an outlet opening is provided in the toner receiving container, which slider closes or opens the filling opening of the toner receiving container, in which a first locking unit is provided in the upper cover part, which first locking unit arrests the lower cover part in the guide in the upper cover part as long as the toner reservoir is not placed on the toner receiving container, in which the slider provides an unlocking unit that unlocks the first locking unit upon placement of the cover on the toner receiving container, such that the lower cover part can be moved, in which the lower cover part and the slider have latching units that enter into an active connection upon placement of the cover onto the toner receiving container, such that the lower cover part simultaneously moves as well with the movement of the slider.

In order to limit the slide travel for the lower cover part, the guide can be locked at one end in the one slide direction in the upper cover part. In the other slide direction, the upper cover part can have as a first locking unit at least one elastic snap clasp that engages in a catch arranged on the lower cover part. As a catch, the lower cover part can have at least one catch toe facing the upper cover part, on which catch toe the snap clasp elastically rests.

It is appropriate when two snap catches in the upper cover part and two catch toes in the lower cover part are provided as a first locking unit.

As a catch unit between the lower cover part and the slider, the lower cover part can have a toe and the slider can have a groove, such that upon placement of the cover on the toner receiving container the toe catches in the groove, and therefore the active connection is established. In order to secure the catching of the lower cover part in the slider, the frame of the toner receiving container into which the toner reservoir is inserted can be designed such that it guides the cover so that the lower cover part engages in the slider via insertion of the toe into the groove.

To facilitate the catching, the slider can have a recess adapted to the shape of the lower cover part, into which recess the lower cover part is inserted when the cover is placed on the toner receiving container.

The locking of the lower cover part with the upper cover part can be achieved in that the recess in the slider ends in at least one toe at one end, which toe the head of a snap clasp respectively strikes when the lower cover part is inserted into the recess, wherein the snap clasp is raised.

It is advantageous when a second locking unit with which the slider can be arrested in the toner receiving container is provided in the toner receiving container. The second locking unit can have a bolt under spring tension, situated in the direction of the slider, which bolt engages in the slider to stop. Furthermore, the second locking unit can have an actuation unit (in particular a magnet) that manipulates the bolt counter to the spring force to release the arrest so that the slider can be slid to open the filling opening of the toner receiving container. The slider can provide at its one end a catch opening in which the bolt can engage. This end of the slider can appropriately be designed as an angled plane that strikes the bolt upon shifting the slider to close the filling opening of the toner receiving container and presses the bolt down so that this can engage in the catch opening. The bolt can thus be pulled in by the magnet when the slider should be drawn out from the toner receiving container at its opening, and the bolt can be moved back into the catch position again by the spring force when the end of the slider has been moved past the slider to the bolt.

The actuation unit can be triggered by a control signal that is prompted by a transponder arranged on the toner reservoir, wherein the transponder emits the control signal to the actuation unit when the toner reservoir may be coupled with the toner receiving container.

Given the arrangement according to the preferred embodiment, next to its slide handle the slider can have the toe, the recess for the lower cover part and subsequently the passage opening for the toner, such that the filling opening of the toner receiving container is closed given the inserted position of the slider and the passage opening is positioned adjacent to the inlet opening of the toner reservoir in the retracted position of the slider, and toner can flow from the outlet opening of the toner reservoir into the filling opening of the toner receiving container via the passage opening.

In order to prevent that, given a partially withdrawn slider, toner can unduly arrive into the surroundings, the upper cover part can possess a turned groove at the area facing towards the passage opening and the frame, and the receiving frame can possess a ledge at this area. When the cover is inserted into the frame, the upper cover part with its turned groove rests on the ledge under pressure and seals this area.

The preferred embodiment thus provides a toner reservoir in which a toner bottle and a cover to receive the toner bottle are provided and the cover is executed such that it closes the outlet opening of the toner bottle as long as this is not inserted into the toner receiving container. The toner reservoir is thus designed so that it can only be opened when it has been inserted into the toner receiving container. For this, the cover provides an upper cover part and a lower cover part guided in the upper cover part, wherein the upper cover part has a first locking unit that arrests the lower cover part in the guide in the upper cover part as long as the toner reservoir is not placed on the toner receiving container. The first locking unit has at least one elastic snap clasp that engages in a catch (for example a catch toe) arranged on the lower cover part. The sliding path of the lower cover part is therefore limited in the one slide direction of the slider. The limitation of the sliding path of the lower cover part in the other direction can be achieved in that the guide for the lower cover part is terminated there.

After placing the toner reservoir on the toner receiving container, the first locking unit is actuated by an unlocking unit (for example a toe) arranged in the toner receiving container such that it releases the arrest of the lower cover part so that the lower cover part can be shifted. Since the lower cover part is simultaneously engaged in the slider, the lower cover part is also shifted with shifting of the slider, and the outlet opening of the toner reservoir is opened, and the passage opening is positioned between the outlet opening of the toner reservoir and the filling opening of the toner receiving container and therefore enables the filling of the toner into the toner receiving container.

To fill toner, the toner reservoir with its cover is thus inserted into the frame of the toner receiving container, wherein the lower cover part of the cover engages in the slider guided in the toner receiving container. The arresting of the lower cover part is then released by the unlocking unit (for example the toe) arranged in the toner receiving container. The slider can now be actuated together with the lower cover part to open and close the filling opening of the toner receiving container.

The arrangement with a toner reservoir TV with cover DE and toner bottle TF, and with a toner receiving container TA with slider SE, results from FIG. 1. A comparable arrangement is described in EP 1 176 477 A1; the content of EP 1 176 477 A1 is herewith incorporated into this disclosure.

Figure 2:
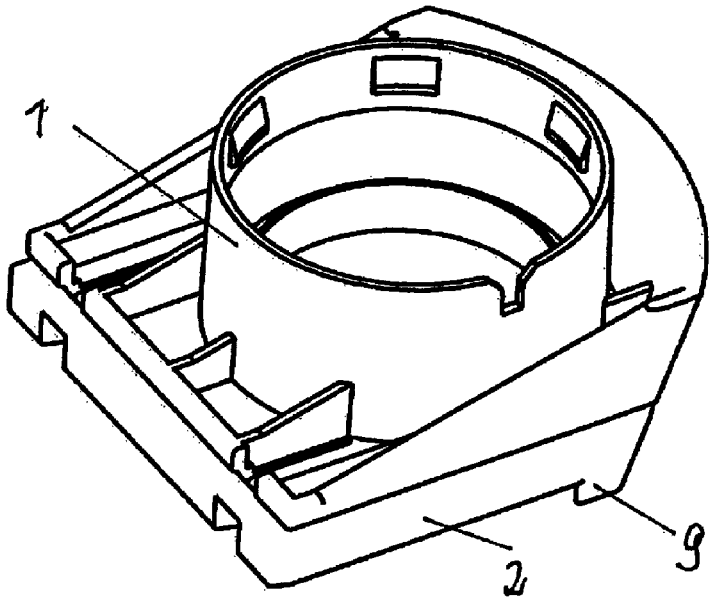
FIG. 2 illustrates a view of the cover.

According to FIG. 2, the cover DE has an upper cover part 1 and a lower cover part 2 that is guided in the upper cover part and must be displaced to open the toner bottle (which is not shown in FIG. 2). The toner bottle is inserted into the upper cover part 1.

Figure 3:
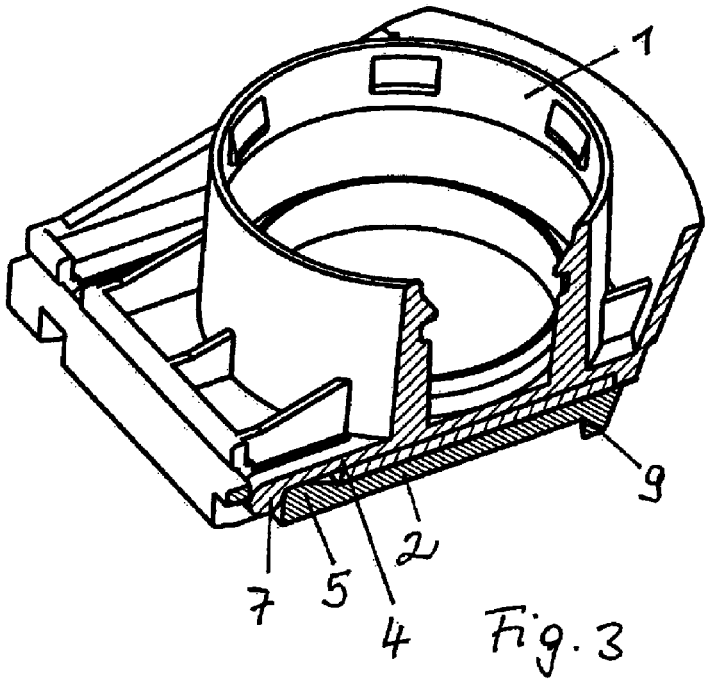
FIG. 3 shows a section through the cover.

How the lower cover part 2 is arranged in the upper cover part (the guide of which is not discernible; see FIG. 2 for this, the guide 22 is shown there) results from the section of FIG. 3. In order to avoid an unintentional opening of the toner bottle, the lower cover part 2 is locked with the upper cover part 1. For this, the upper cover part 1 has a first locking unit that is realized as a snap clasp 4 that is elastically arranged in the upper cover part 1. The snap clasp 4 acts with a catch 5 (for example a catch toe) in order to establish the locking. The lower cover part 2 can therefore no longer shift in the one direction (to the left in FIG. 3). In order to also prevent that the lower cover part 2 can be shifted in the other direction (thus to the right), the guide for the lower cover part 2 is terminated in this direction. The result is that the lower cover part 2 cannot be moved since the snap clasp 4 blocks in the one direction and the lower cover part 2 abuts the termination 23 of the guide 22 in the other direction.

Figure 4:
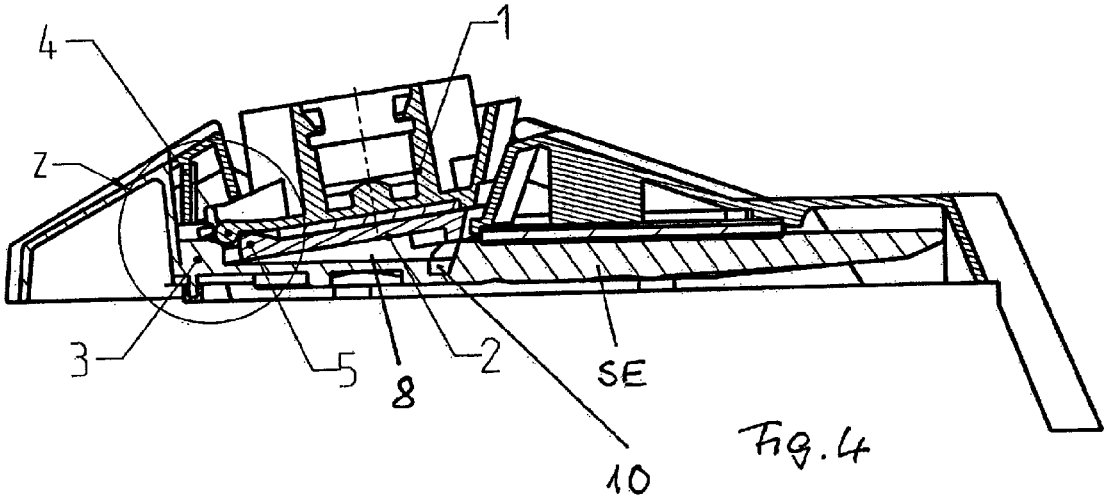
FIG. 4 shows the arrangement in section at the beginning of the placement event of the cover on the slider.
Figure 5:
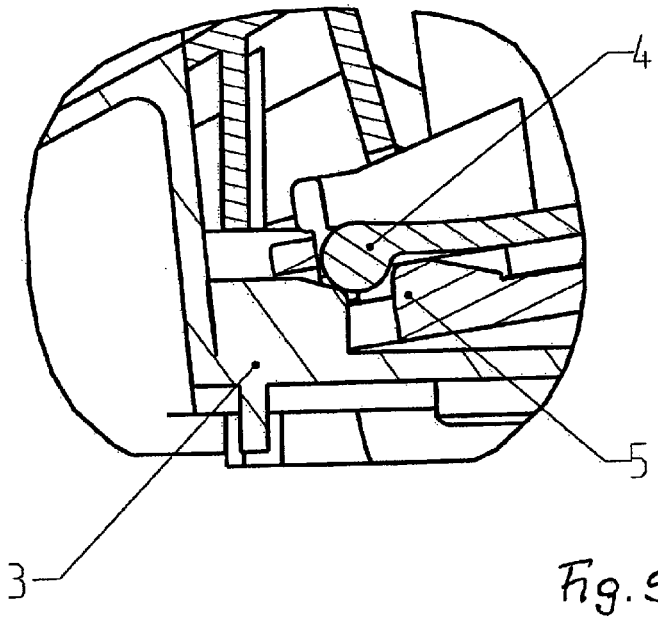
FIG. 5 illustrates a section through FIG. 4 that shows the position of a first locking unit.

How the cover 1, 2 (without toner bottle) is inserted into a frame 6 that is a component of the toner receiving container is shown in FIGS. 4 and 5. The frame 6 is executed such that it conducts the cover 1, 2 upon insertion to the slider SE (which is borne in the frame 6) so that the cover 1, 2 is fitted exactly in the slider. The beginning of the insertion is shown in FIG. 4; the lower cover part 2 is arrested. The arrest is shown more clearly in FIG. 5; here the head 7 of the snap clasp 4 is shown as it is engaged at the catch 5. It is shown that the head 7 strikes a toe 3 in the slider SE; however, the locking is still maintained.

Figure 6:
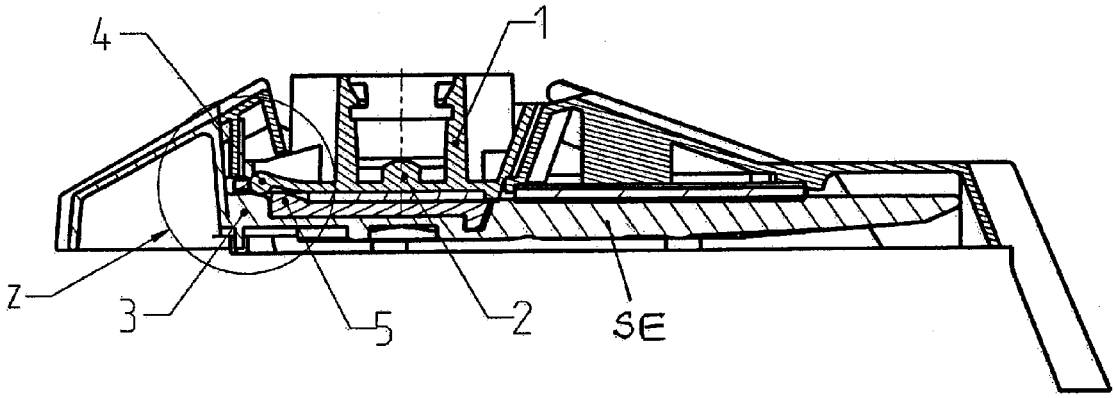
FIG. 6 shows the arrangement in section at the end of the placement event of the cover on the slider.
Figure 7:
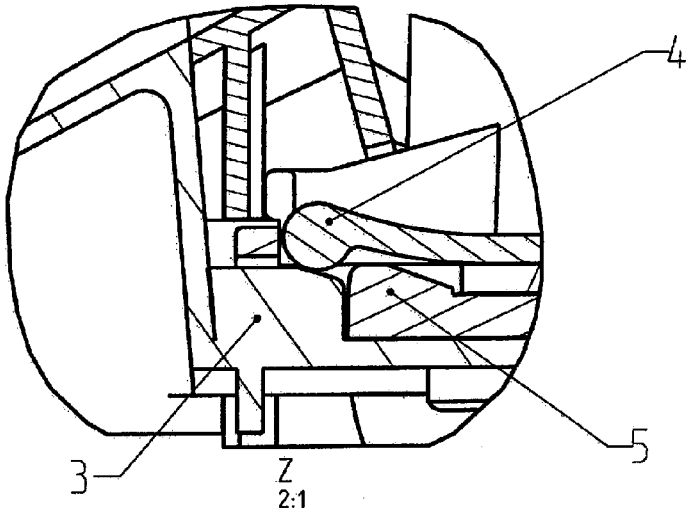
FIG. 7 illustrates a segment from FIG. 6 that shows the position of the first locking means.

FIGS. 6 and 7 show the end of the placement. The lower cover part 2 engages in a recess 8 in the slider SE. For this, the lower cover part 2 has the catch toe 5 on the one side and a nose 9 on the other side. The nose 9 engages in a groove 10 in the recess 8. The lower cover part 2 in the slider SE is now arrested and can be moved with the slider SE. In this position, the toe 3 raises the snap clasp 4 so that the locking between upper cover part 1 and lower cover part 2 is released and the lower cover part 2 is also moved with the movement of the slider SE.

A snap clasp is shown as a locking unit in FIGS. 2 through 7. The use of two snap clasps 4 and two toes 3 associated with these, respectively one on both sides of the upper cover part 1, is advantageous.

Figure 8:
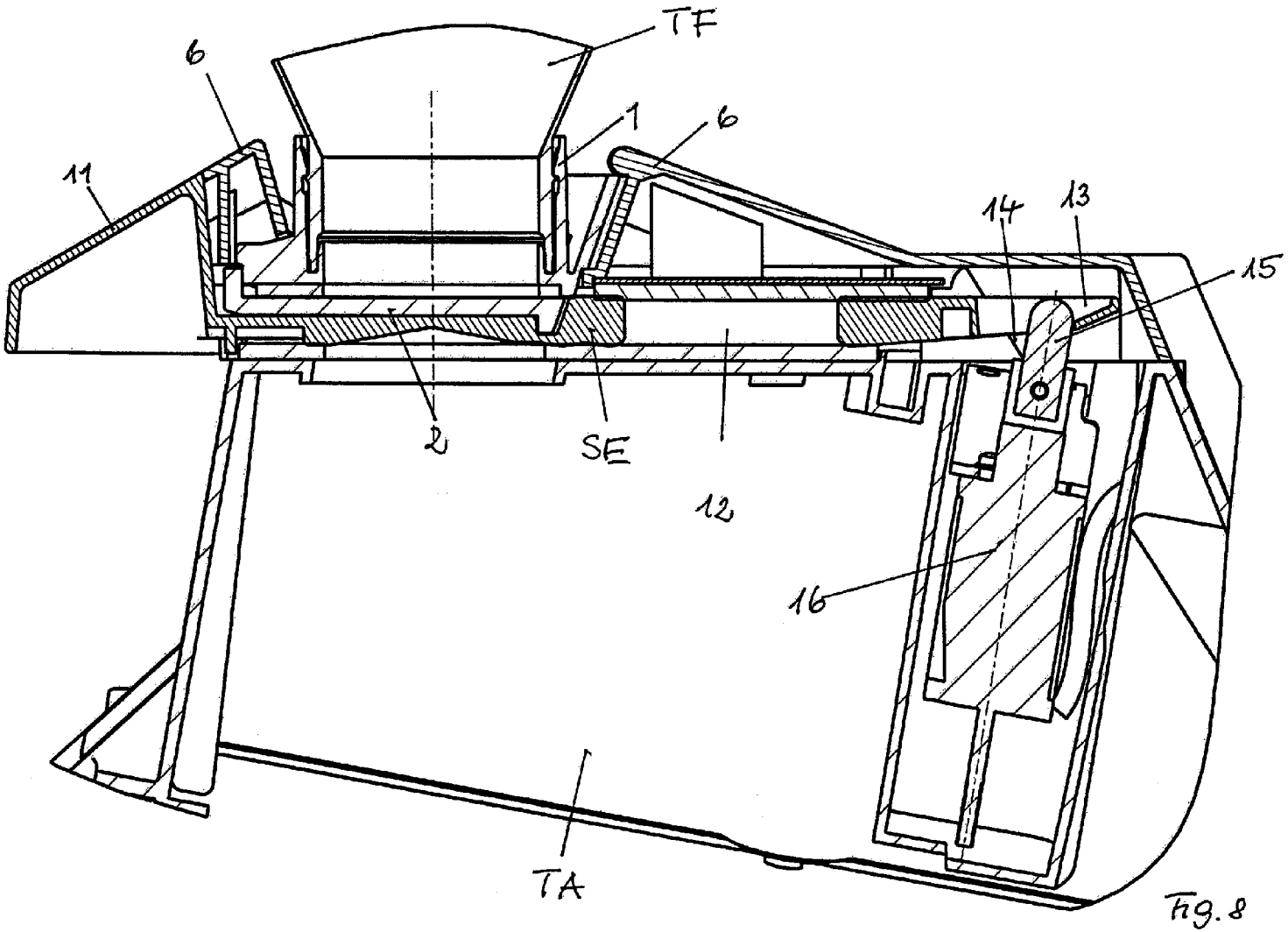
FIG. 8 illustrates a representation in section of a second locking unit to arrest the slider when the second locking unit is engaged.

The slider SE can likewise be arrested, and in fact in the toner receiving container TA. This case can be learned from FIG. 8. Here the cover 1, 2 is shown with toner bottle TF and the toner receiving container TA. Furthermore, the shape of the slider SE can be learned from FIG. 8. This has a slide handle 11 and, following this, the recess 8 for the lower cover part 2, a passage opening 12 for the toner and an end piece 13. The end piece 13 has a catch opening 14 in which a second locking means arranged in the toner receiving unit TA can engage. This second locking unit can have a bolt 15 under spring tension and an actuation unit for the bolt 14, for example a magnet 16 such as a lifting magnet, for instance. Other actuation unit are likewise possible, such as compressed air, for example. In the following, a magnet is assumed as the actuation unit in the explanation. When the magnet 16 is not actuated, the bolt 15 engages in the catch opening 14 of the slider SE due to the spring tension and arrests the slider SE. In this position, no passage exists for toner from the toner reservoir TV into the toner receiving container TA.

Figure 9:
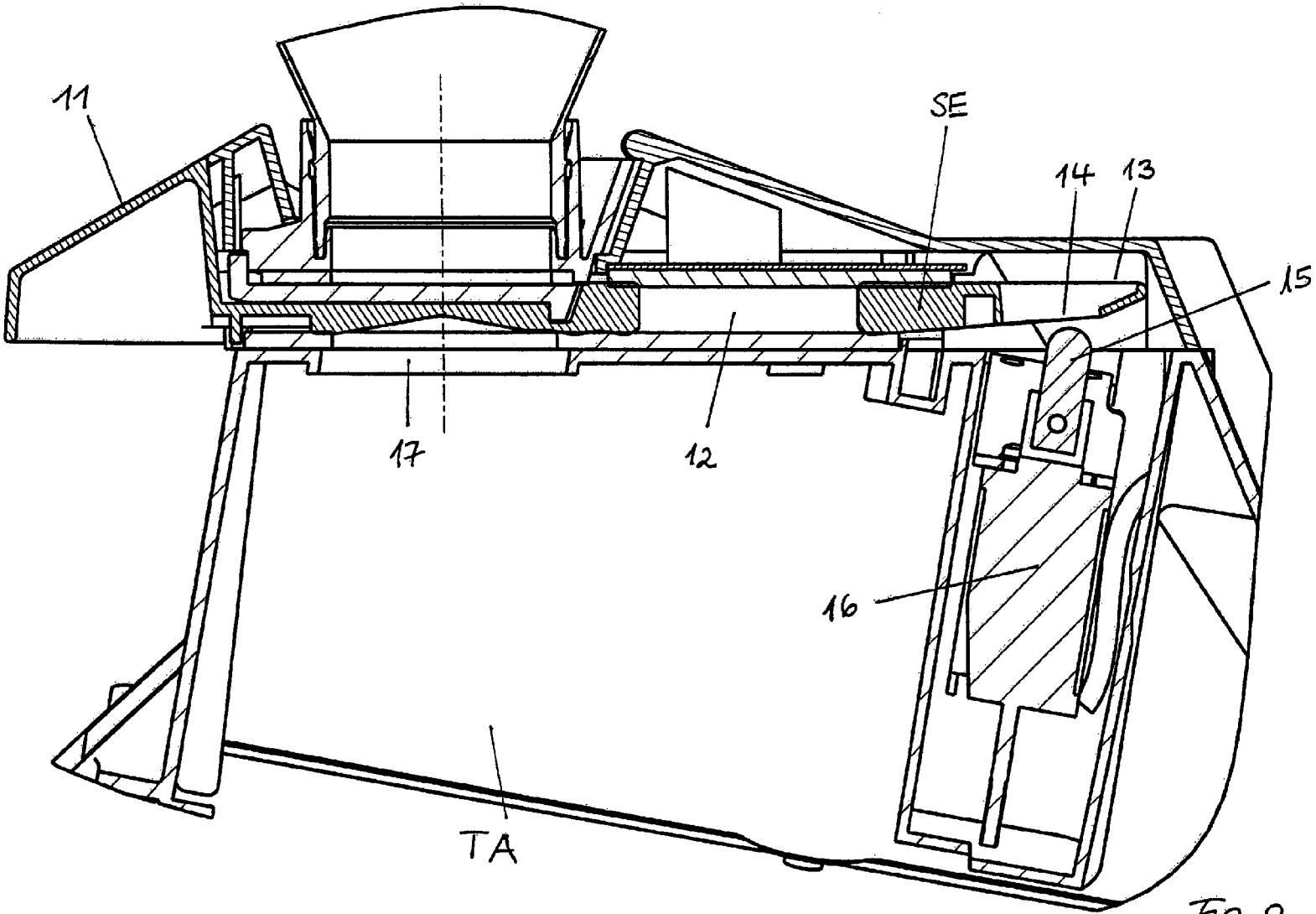
FIG. 9 is a representation in section of the second locking unit to arrest the slider when the second locking unit is unlocked.
Figure 10:
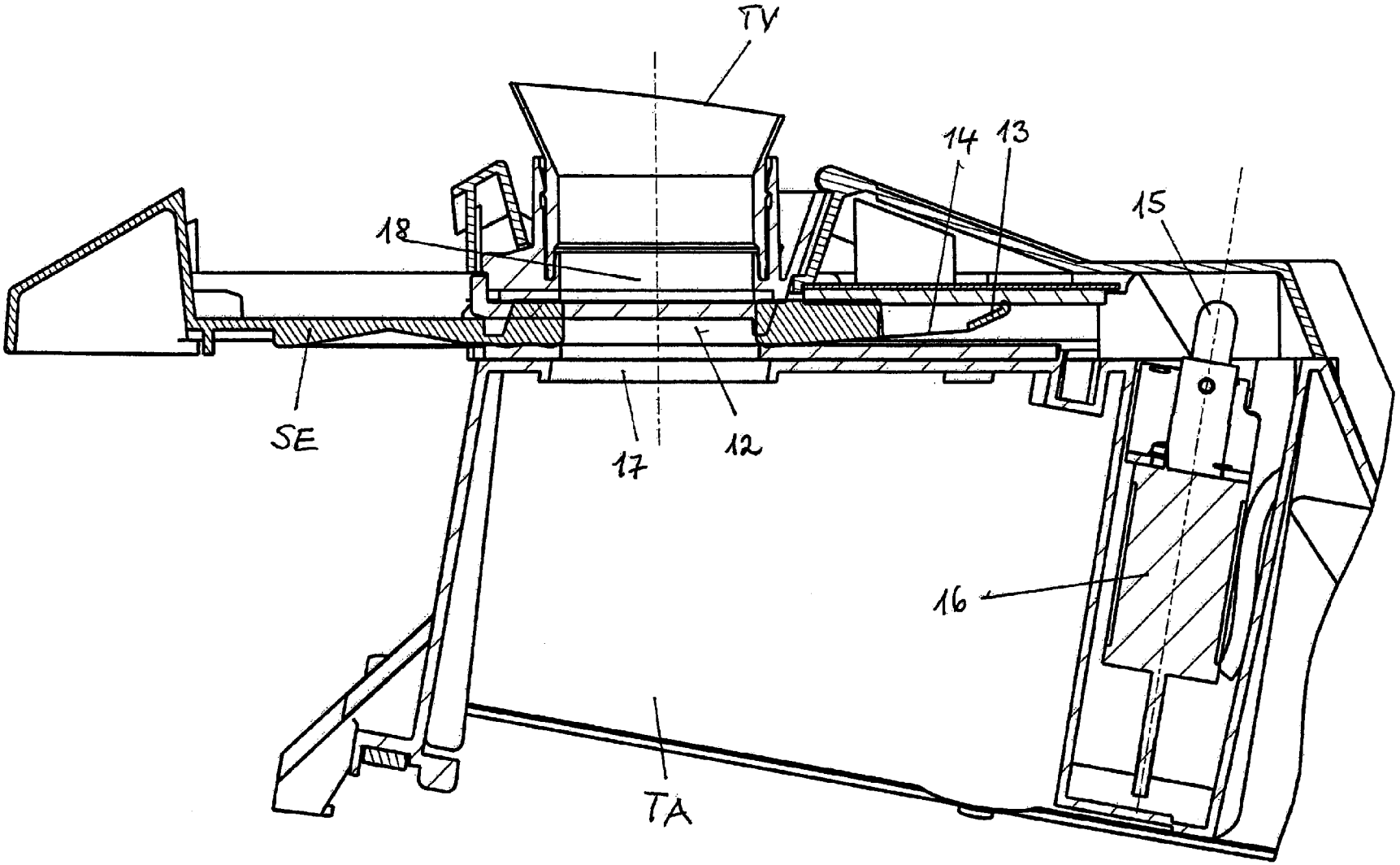
FIG. 10 is a representation in section of the second locking unit to arrest the slider when the slider is in the withdrawn position.
Figure 11:
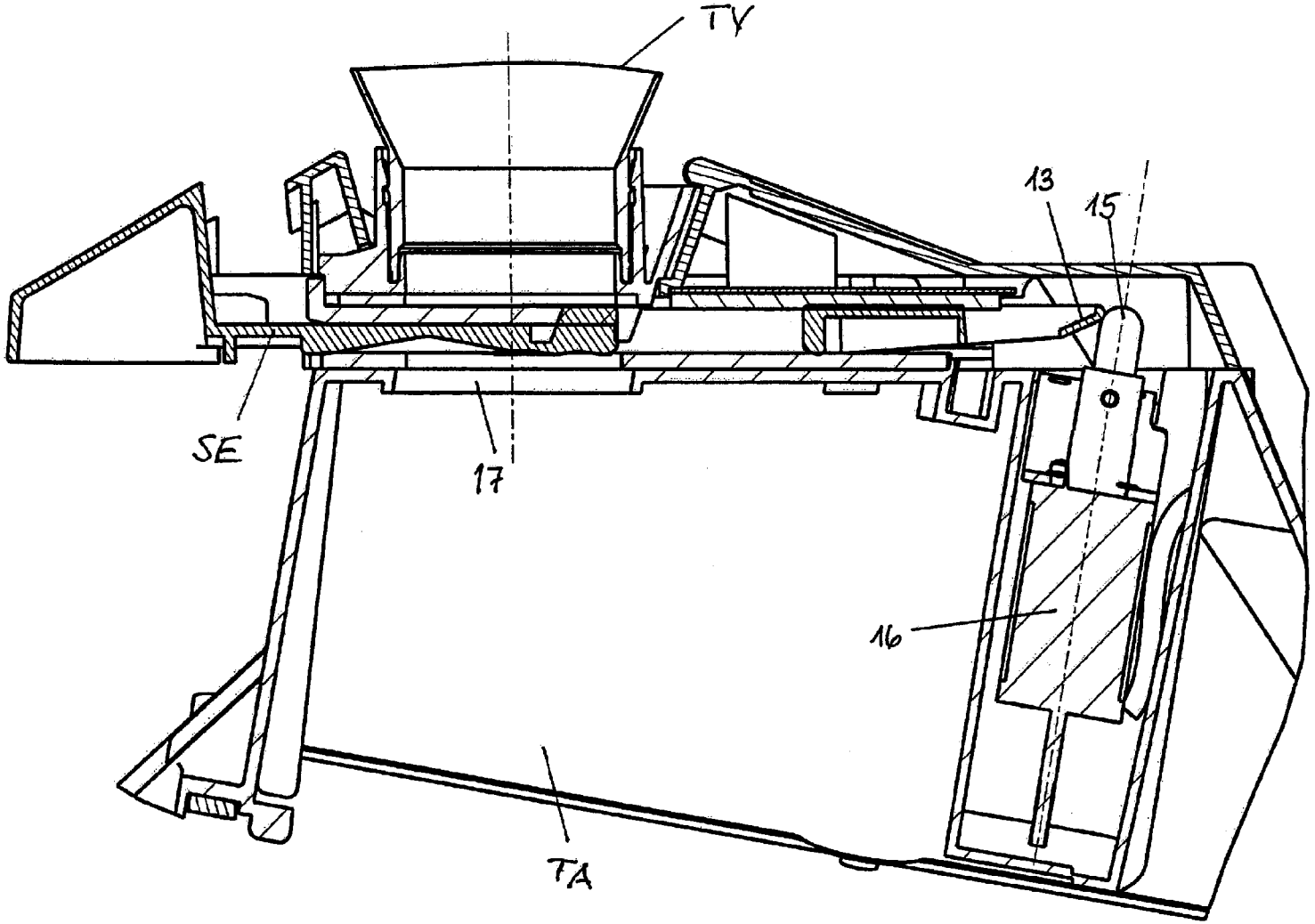
FIG. 11 is a representation in section of the second locking unit to arrest the slider when the slider is inserted into the toner receiving container shortly before engaging the second locking unit.

If toner should be filled into the toner receiving container TA, the slider SE must be drawn out from the toner receiving container TA. It is required that the bolt 15 is attracted by the magnet 16 and therefore leaves the catch opening 14. This case results from FIG. 9. The slider SE can now be drawn out from the toner receiving container TA until the passage position for the toner is reached (FIG. 10). In this position of the slider, the passage opening 12 of the slider SE lies between the outlet opening 12 of toner reservoir TV and the inlet opening 17 of the toner receiving container. Toner can now flow from the toner reservoir into the toner receiving container. If the bolt 15 is no longer attracted by the magnet 16, it moves into the position of FIG. 8, however without being able to engage in the catch opening 14.

If the slider SE is slid back and therefore the filling opening of the toner receiving container is sealed again, the end piece 13 (formed as an inclined plane) strikes the bolt 15 and presses this downward, counter to the spring force, until this can engage in the catch opening 14 due to the spring force. The slider SE can now no longer be shifted. The position of FIG. 8 is achieved again, the lower cover part 2 can again be released from the coupling with the slider SE and the toner reservoir TV with the cover 1, 2 can then be removed.

The actuation of the magnet 16 can be triggered by a control signal that, for example, is derived from a signal of a transponder associated with the toner bottle, in which signal information is stored about the content of the toner bottle. If the content of the toner bottle is permitted for filling into the toner receiving container, the control signal is generated that triggers the magnet 16 so that the bolt 15 is drawn out from the catch opening 14.

Figures 12, 13:
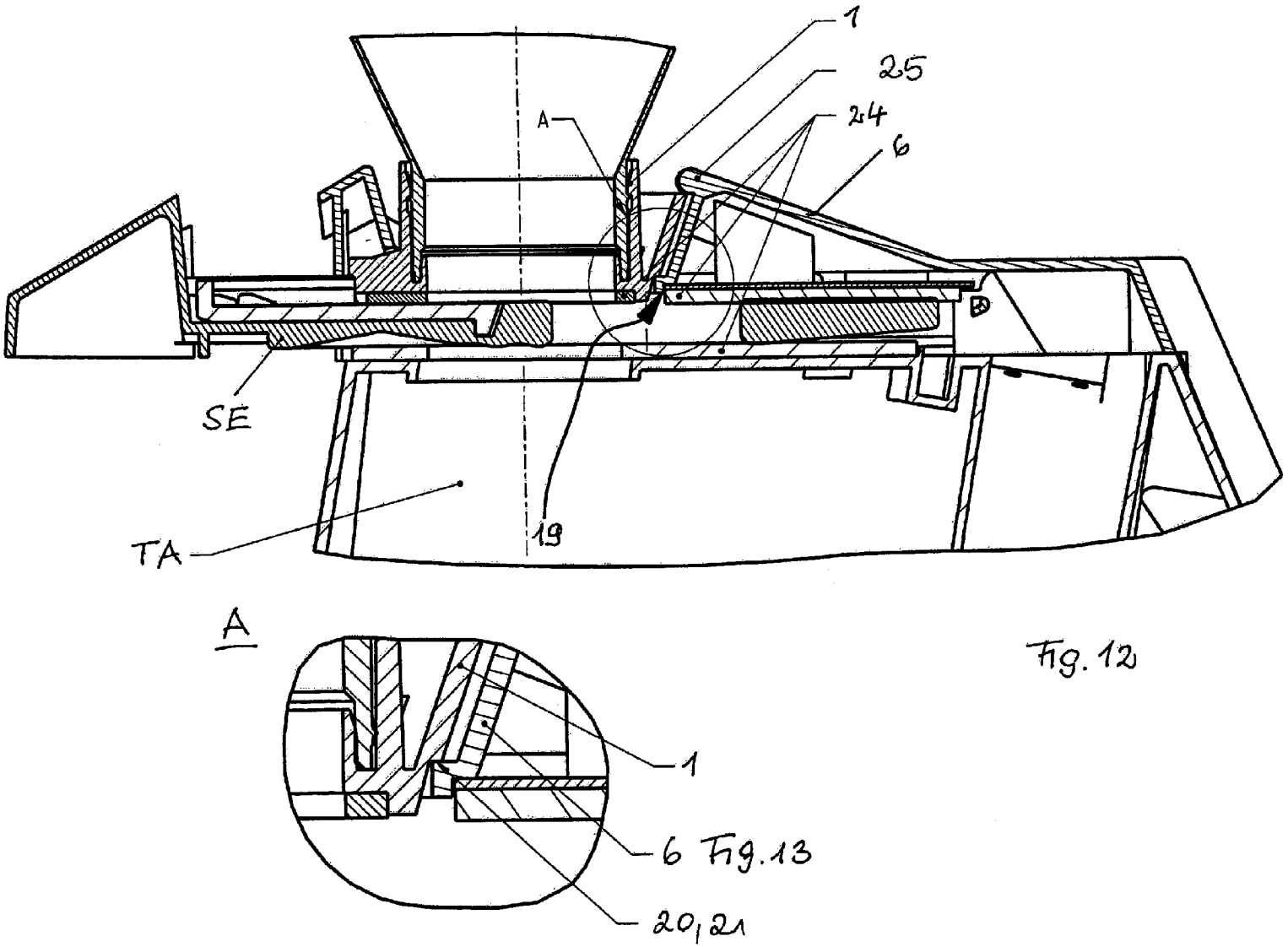
FIG. 12 is a representation in section of the seal between cover and frame.
FIG. 13 is a segment from FIG. 12 that clearly shows the realization of the seal.

If the slider SE is partially withdrawn from the toner receiving container TA and the passage opening 12 only partially uncovers the passage for the toner, the danger exists that toner can exit in an undesirable manner into the surroundings. This case is to be learned from FIG. 12, which shows a different slice direction in comparison to preceding Figures. The point at which toner can escape is indicated by the arrow 19. This is prevented by a special design of the frame 6 and of the upper cover part 1. At this area at which the possibility of the toner exist exists, the upper cover part 1 has a turned groove 20 and the frame 6 has a ledge 21. Upon insertion of the cover 1, 2 into the frame 6, the turned groove 20 hits the ledge 21 and seals this area.

An optimal seal occurs when the turned groove 20 rests under pressure on the ledge 21 in the frame 6. This can be realized so that a nose 25 in frame 6 on the wall of the upper cover part 1 exerts pressure on the sealing surface after the insertion of the toner reservoir TV. The nose 25 is well visible in FIG. 12. The compressive strain thus forms between this nose 25 and the sealing surface. The realization of turned groove 20 and ledge 21 can be more clearly recognized from FIG. 14, 15. How the turned groove 20 is arranged at the upper cover part 1 can be learned from FIG. 14. The counterpart (the ledge 21) can be learned from FIG. 15.

Figure 14:
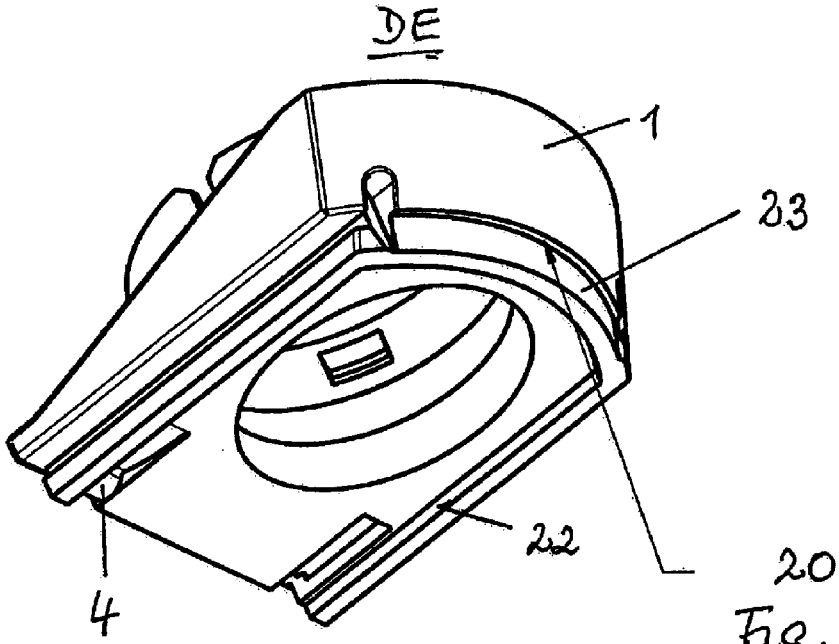
FIG. 14 illustrates the underside of the cover with the turned groove.
Figure 15:
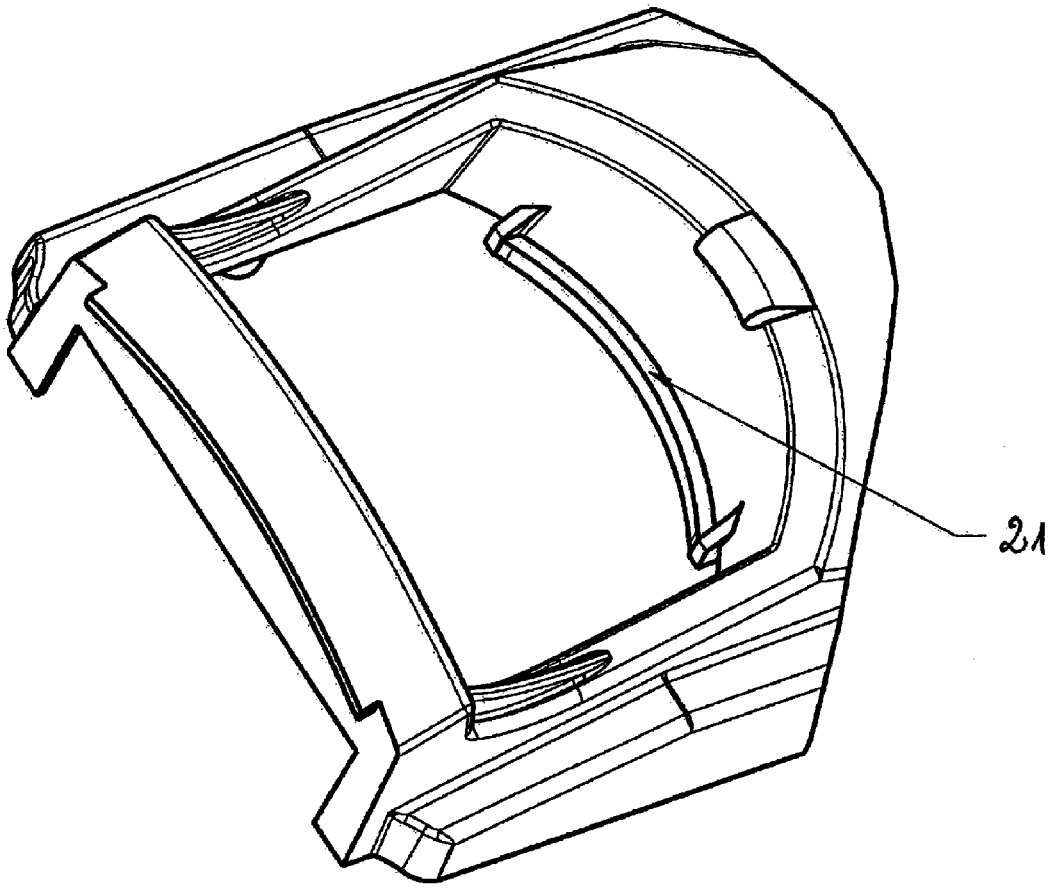
FIG. 15 shows the frame with the ledge that interacts with the turned groove for sealing.

It can additionally be recognized from FIG. 14 that two snap clasps 4 can be used. Furthermore, the guide 22 for the lower cover part 2 is recognizable with the termination 23 to limit the slide travel for the lower cover part 2. Sealing elements 24 can additionally be learned.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. An arrangement to convey toner from a toner reservoir into a toner receiving container, comprising:

the toner reservoir comprising a toner bottle and a cover to close an outlet opening of the toner bottle;

said cover having an upper cover part to accept the toner bottle and a lower cover part to close the outlet opening of the toner bottle;

a first locking unit provided within the cover, the first locking unit arresting the lower cover part to the upper cover part so that the lower cover part is connected with the upper cover part such that it cannot be displaced before placement of the toner reservoir onto the toner receiving container;

the cover being insertable into a frame on the toner receiving container such that the outlet opening of the toner reservoir is positioned above a filling opening of the toner receiving container;

a slider having an outlet opening, the slider closing or opening the filing opening of the toner receiving container;

the slider having an unlocking unit that unlocks the first locking unit upon placement of the toner reservoir on the toner receiving container such that the lower cover part is no longer arrested to the upper cover part; and the lower cover part and the slider having a latching unit that engages in an active connection upon placement of the toner reservoir onto the toner receiving container, such that the lower cover part simultaneously moves as well with movement of the slider.

2. An arrangement according to claim 1, wherein:

the first locking unit limits the movement of the lower cover part in one slide direction, and a guide for the lower cover part has at one end a termination to limit a slide travel of the lower cover part in another direction.

3. An arrangement according to claim 1 in which at least one elastic snap clasp is provided in the upper cover part as the first locking unit and an associated catch is provided on the lower cover part.

4. An arrangement according to claim 3 in which the lower cover part has at least one catch toe facing the upper cover part, and on this catch toe a snap clasp elastically rests.

5. An arrangement according to claim 3 in which two snap catches in the upper cover part and two catch toes in the lower cover part are provided as the first locking unit.

6. An arrangement according to claim 1 in which the slider has a recess adapted to a shape of the lower cover part and into the recess the lower cover part is inserted when the toner reservoir is placed on the toner receiving container.

7. An arrangement according to claim 1 in which as a catch unit the lower cover part has a nose and the slider has a groove, such that upon placement of the toner reservoir on the toner receiving container the nose engages in the groove, and therefore the active connection is established.

8. An arrangement according to claim 7 in which a frame of the toner receiving container is designed such that it guides the cover so that the lower cover part engages in the slider via insertion of the nose into the groove.

9. An arrangement according to claim 7 in which the lower cover part has a catch at one end on the side facing towards the upper cover part and has the nose at the other end on the side facing towards the slider.

10. An arrangement according to claim 1 in which a second locking unit with which the slider is arrested in the toner receiving container is provided in the toner receiving container.

11. An arrangement according to claim 10 in which the second locking unit has a bolt under spring tension situated in a direction of the slider, said bolt engaging in the slider to stop.

12. An arrangement according to claim 11 in which the second locking unit furthermore has an actuation unit that manipulates the bolt counter to a spring force to release an arrest so that the slider slides to open the filling opening of the toner receiving container.

13. An arrangement according to claim 11 in which the slider has at one end a catch opening in which the bolt engages.

14. An arrangement according to claim 13 in which an end piece of the slider is formed as an inclined plane that strikes the bolt upon shifting the slider to close the filling opening of the toner receiving container and presses the bolt down, counter to a spring force, so that it can engage in the catch opening.

15. An arrangement according to claim 7 in which next to a slide handle the slider has a toe, followed by a recess for the lower cover part and subsequently a passage opening, such that the filling opening of the toner receiving container is closed given the inserted position of the slider and the passage opening is positioned adjacent to the filling opening in the retracted position of the slider.

16. An arrangement according to claim 1, wherein:

the upper cover part has a turned groove at a region facing towards a passage opening and the frame;

the frame has a ledge at said region; and the upper cover part with said turned groove rests on the ledge for sealing when the cover is inserted into the frame.

17. An arrangement according to claim 16 in which the frame has a node such that after the insertion of the cover into the frame, the turned groove of the upper cover part rests under pressure on the ledge.

18. An arrangement to convey toner from a toner reservoir into a toner receiving container, comprising:

the toner reservoir comprising a toner bottle and a cover to close an outlet opening of the toner bottle;

said cover having an upper cover part to accept the toner bottle and a lower cover part to close the outlet opening of the toner bottle;

a first locking unit provided within the cover, the first locking unit arresting the lower cover part to the upper cover part so that the lower cover part is connected with the upper cover part such that it cannot be displaced before placement of the toner reservoir onto the toner receiving container;

the cover being insertable into a frame on the toner receiving container such that the outlet opening of the toner reservoir is positioned above a filling opening of the toner receiving container;

a slider having an outlet opening, the slider closing or opening the filing opening of the toner receiving container;

the slider having an unlocking unit that unlocks the first locking unit upon placement of the toner reservoir on the toner receiving container such that the lower cover part is no longer arrested to the upper cover part;

the lower cover part and the slider having a latching unit that engages in an active connection upon placement of the toner reservoir onto the toner receiving container, such that the lower cover part simultaneously moves as well with movement of the slider;

the slider having a recess adapted to a shape of the lower cover part and into the recess the lower cover part being inserted when the toner reservoir is placed on the toner receiving container; and the recess in the slider ending in at least one toe at one end, and a head cover part is inserted into the recess, a snap clasp of the upper cover part being raised.

19. An arrangement to convey toner from a toner reservoir into a toner receiving container, comprising:

the toner reservoir comprising a toner bottle and a cover to close an outlet opening of the toner bottle;

said cover having an upper cover part to accept the toner bottle and a lower cover part to close the outlet opening of the toner bottle;

a first locking unit provided within the cover, the first locking unit arresting the lower cover part to the upper cover part so that the lower cover part is connected with the upper cover part such that it cannot be displaced before placement of the toner reservoir onto the toner receiving container;

the cover being insertable into a frame on the toner receiving container such that the outlet opening of the toner reservoir is positioned above a filling opening of the toner receiving container;

a slider having an outlet opening, the slider closing or opening the filing opening of the toner receiving container;

the slider having an unlocking unit that unlocks the first locking unit upon placement of the toner reservoir on the toner receiving container such that the lower cover part is no longer arrested to the upper cover part;

the lower cover part and the slider having a latching unit that engages in an active connection upon placement of the toner reservoir onto the toner receiving container, such that the lower cover part simultaneously moves as well with movement of the slider;

a second locking unit with which the slider is arrested in the toner receiving container being provided in the toner receiving container;

the second locking unit having a bolt under spring tension situated in a direction of the slider, said bolt engaging in the slider to stop;

the second locking unit furthermore having an actuation unit that manipulates the bolt counter to a spring force to release an arrest so that the slider slides to open the filling opening of the toner receiving container;

the bolt being pulled in by a magnet when the slider is drawn out from the toner receiving container at its opening; and the actuation unit releasing the bolt when the end of the slider is moved past the bolt, such that the bolt is moved back into the catch position again by the spring force.

20. An arrangement to convey toner from a toner reservoir into a toner receiving container, comprising:

the toner reservoir comprising a toner bottle and a cover to close an outlet opening of the toner bottle;

said cover having an upper cover part to accept the toner bottle and a lower cover part to close the outlet opening of the toner bottle;

a first locking unit provided within the cover, the first locking unit arresting the lower cover part to the upper cover part so that the lower cover part is connected with the upper cover part such that it cannot be displaced before placement of the toner reservoir onto the toner receiving container;

the cover being insertable into a frame on the toner receiving container such that the outlet opening of the toner reservoir is positioned above a filling opening of the toner receiving container;

a slider having an outlet opening, the slider closing or opening the filing opening of the toner receiving container;

the slider having an unlocking unit that unlocks the first locking unit upon placement of the toner reservoir on the toner receiving container such that the lower cover part is no longer arrested to the upper cover part;

the lower cover part and the slider having a latching unit that engages in an active connection upon placement of the toner reservoir onto the toner receiving container, such that the lower cover part simultaneously moves as well with movement of the slider;

a second locking unit with which the slider is arrested in the toner receiving container provided in the toner receiving container;

the second locking unit having a bolt under spring tension situated in a direction of the slider, said bolt engaging in the slider to stop;

the second locking unit furthermore having an actuation unit that manipulates the bolt counter to a spring force to release an arrest so that the slider slides to open the filling opening of the toner receiving container;

the actuation unit being triggered by a signal that is from a transponder arranged on the toner reservoir such that the actuation unit draws the bolt out from the catch opening so that the slider is shifted; and the transponder emitting the signal to the actuation unit when the toner reservoir is coupled with the toner receiving container.

21. A toner reservoir, comprising:

a toner bottle and a cover to receive the toner bottle;

the cover is provided at an upper cover part to receive the toner bottle and a lower cover part that is displaced in a guide in the upper cover part to close or open an outlet opening of the toner bottle;

a first locking unit within the cover that locks the lower cover part to the upper cover part such that the lower cover part is connected with the upper cover part and such that said lower cover part cannot shift as long as the toner bottle is not inserted into a toner receiving container;

as said first locking unit at least one elastic snap clasp is provided in the upper cover part and at least one catch toe facing the elastic snap clasp in the upper cover part is provided in the lower cover part and on the catch toe the snap clasp elastically rests; and the snap clasp being engaged on the catch toe to lock the upper cover part with the lower cover part.

22. A toner reservoir according to claim 21 in which two snap clasps are provided in the upper cover part and two associated catch toes are provided in the lower cover part as said first locking unit.

23. A toner reservoir according to claim 21 in which the first locking unit is actuated by an unlocking unit arranged in the toner receiving container such that it releases the locking of the lower cover part.

24. A toner reservoir, comprising:

a toner bottle and a cover to receive the toner bottle;

the cover is provided at an upper cover part to receive the toner bottle and a lower cover part that is displaced in a guide in the upper cover part to close or open an outlet opening of the toner bottle;

a first locking unit within the cover that locks the lower cover part to the upper cover part such that the lower cover part is connected with the upper cover part and such that said lower cover part cannot shift as long as the toner bottle is not inserted into a toner receiving container;

as said first locking unit at least one elastic snap clasp is provided in the upper cover part and at least one catch toe facing the elastic snap clasp in the upper cover part is provided in the lower cover part and on the catch toe the snap clasp elastically rests;

the snap clasp being engaged on the catch toe to lock the upper cover part with the lower cover part;

the first locking unit being actuated by an unlocking unit arranged in the toner receiving container such that it releases the locking of the lower cover part; and the unlocking unit having a toe that, upon placement of the toner reservoir on the toner receiving container, raises the snap clasp so that the catch and therefore the lower cover part can be shifted.

25. A method to fill toner into a toner receiving container in an electrographic printer or copier, comprising the steps of:

providing a toner reservoir comprising a toner bottle and a cover to close an outlet opening of the toner bottle, said cover having an upper cover part to accept the toner bottle and the lower cover part to close the outlet opening of the toner bottle, and a first locking unit provided within the cover;

providing a slider having an outlet opening and an unlocking unit that unlocks the first locking unit;

providing the lower cover part and the slider with a latching unit;

before placement of the toner reservoir onto the toner receiving container said first locking unit arresting the lower cover part to the upper cover part so that the lower cover part is connected with the outer cover part such that it cannot be displaced before said placement of the toner reservoir onto the toner receiving container;

inserting the toner bottle onto the toner receiving container such that the outlet opening of the toner reservoir toner bottle is positioned above a filling opening of the toner receiving container;

the slider unlocking unit unlocking the first locking unit upon placement of the toner reservoir on the toner receiving container so that the lower cover part is no longer arrested in the outer cover part;

activating the slider so that the filling opening of the toner receiving container is opened for filling; and said latching unit engaging in an active connection upon placement of the toner reservoir onto the toner receiving container such that the lower cover part simultaneously moves as well with movement of the slider.

26. An arrangement to convey toner from a toner reservoir into a toner receiving container, comprising:

the toner reservoir comprising a toner bottle and a cover to close an outlet opening of the toner bottle;

said cover having an upper cover part to accept the toner bottle and a lower cover part to close the outlet opening of the toner bottle;

a first locking unit provided within the cover, the first locking unit arresting the lower cover part to the upper cover part such that it cannot be displaced before placement of the toner reservoir onto the toner receiving container;

the cover being receivable on the toner receiving container such that the outlet opening of the toner reservoir is positioned above a filling opening of the toner receiving container;

a slider having an outlet opening, the slider closing or opening the filing opening of the toner receiving container;

the slider having an unlocking unit that unlocks the first locking unit upon placement of the toner reservoir on the toner receiving container such that the lower cover part is no longer arrested to the upper cover part; and the lower cover part and the slider having a latching unit that engages in an active connection upon placement of the toner reservoir onto the toner receiving container, such that the lower cover part moves with movement of the slider.

27. An arrangement to convey toner from a toner reservoir into a toner receiving container, comprising:

the toner reservoir comprising a toner bottle and a cover to close an outlet opening of the toner bottle;

said cover having an upper cover part to accept the toner bottle and a lower cover part to close the outlet opening of the toner bottle;

the cover being insertable over the toner receiving container such that the outlet opening of the toner reservoir is positioned above a filling opening of the toner receiving container;

a slider having an outlet opening, the slider closing or opening the filing opening of the toner receiving container;

the slider having an unlocking unit that unlocks the first locking unit upon placement of the toner reservoir on the toner receiving container such that the lower cover part is no longer arrested to the upper cover part; and the lower cover part and the slider having a latching unit that engages in an active connection upon placement of the toner reservoir onto the toner receiving container, such that the lower cover part simultaneously moves as well with movement of the slider.

28. An arrangement to convey toner from a toner reservoir into a toner receiving container, comprising:

the toner reservoir comprising a toner bottle and a cover to close an outlet opening of the toner bottle;

said cover having an upper cover part to accept the toner bottle and a lower cover part to close the outlet opening of the toner bottle;

the cover being insertable over of the toner receiving container such that the outlet opening of the toner reservoir is positioned above a filling opening of the toner receiving container;

a slider having an outlet opening, the slider moving the lower cover part to open the toner battle and also opening the filling opening of the toner receiving container;

a locking unit with which the slider is arrested;

an actuation unit triggered by a signal from a transponder arranged on the toner reservoir such that the actuation unit opens the locking unit to allow the slider to be shifted; and the transponder emitting the signal to the actuation unit when the toner reservoir is coupled with the toner receiving container.

29. An arrangement according to claim 28 wherein the transponder emits the signal if correct toner is detected in the toner battle.

30. An arrangement to convey toner from a toner reservoir into a toner receiving container, comprising:

the toner reservoir comprising a toner bottle and a cover to close an outlet opening of the toner bottle;

said cover having an upper cover part to accept the toner bottle and a lower cover part to close the outlet opening of the toner bottle;

the cover being insertable into a frame on the toner receiving container such that the outlet opening of the toner reservoir is positioned above a filling opening of the toner receiving container;

a slider having an outlet opening, the slider closing or opening the filing opening of the toner receiving container;

the lower cover part and the slider having a latching unit that engages in an active connection upon placement of the toner reservoir onto the toner receiving container, such that the lower cover part simultaneously moves as well with movement of the slider; and the upper cover part having a turned groove in a region facing towards a passage opening in the frame receiving the upper cover part;

the frame having a ledge at said region; and the upper cover part with said turned groove resting on the ledge for sealing when the cover is inserted into the frame.

* * * * *